US010629355B2

(12) United States Patent
Kakugawa et al.

(10) Patent No.: US 10,629,355 B2
(45) Date of Patent: Apr. 21, 2020

(54) STATIONARY INDUCTION APPARATUS

(71) Applicant: Hitachi, Ltd., Chiyoda-ku, Toyko (JP)

(72) Inventors: Shigeru Kakugawa, Tokyo (JP); Yasunori Ono, Tokyo (JP); Mao Kawamoto, Tokyo (JP); Akira Yamagishi, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 16/003,764

(22) Filed: Jun. 8, 2018

(65) Prior Publication Data

US 2018/0358160 A1 Dec. 13, 2018

(30) Foreign Application Priority Data

Jun. 8, 2017 (JP) ..... 2017-113116

(51) Int. Cl.

| | |
|---|---|
| ***H01F 27/30*** | (2006.01) |
| ***H01F 27/12*** | (2006.01) |
| ***H01F 27/26*** | (2006.01) |
| ***H01F 30/12*** | (2006.01) |
| ***H01F 27/28*** | (2006.01) |
| ***H01F 27/22*** | (2006.01) |

(52) U.S. Cl.

CPC ..... *H01F 27/12* (2013.01); *H01F 27/22* (2013.01); *H01F 27/26* (2013.01); *H01F 27/2828* (2013.01); *H01F 27/306* (2013.01); *H01F 30/12* (2013.01)

(58) Field of Classification Search

CPC ..... H01F 27/12; H01F 27/26; H01F 30/12; H01F 27/2828

USPC ..... 336/84 R, 84 C, 84 M, 196, 197

See application file for complete search history.

(56) References Cited

U.S. PATENT DOCUMENTS

| | | | | |
|---|---|---|---|---|
| 3,366,907 A * | 1/1968 | Tipton | ..... | H01F 27/303 336/197 |
| 3,467,932 A * | 9/1969 | Feather | ..... | H01F 27/303 336/197 |
| 3,750,070 A * | 7/1973 | Rissinger | ..... | H01F 27/303 336/84 R |

(Continued)

FOREIGN PATENT DOCUMENTS

| | | |
|---|---|---|
| JP | 53-25092 | 7/1978 |
| JP | 2-148811 | 6/1990 |

*Primary Examiner* — Tszfung J Chan

(74) *Attorney, Agent, or Firm* — Crowell & Moring LLP

(57) ABSTRACT

A stationary induction apparatus includes a cooled magnetic material ring disposed in an end portion of each winding and that can reduce an electromagnetic-mechanical force and improve reliability. The apparatus includes an iron core; a winding outside of the iron core; a plurality of iron core clamps that sandwich the winding from a longitudinal direction of the iron core; a magnetic material ring with a silicon steel plate wound outside of the iron core; a laminated magnetic material composite ring including an insulator on an outer circumference of the magnetic material ring; and a holding-and-cooling structure between the winding and the laminated magnetic material composite ring, in which a portion of the holding-and-cooling structure protruding from between the winding and the laminated magnetic material composite ring extends in the longitudinal direction, and the holding-and-cooling structure is a recess with respect to the winding and the laminated magnetic material composite ring.

5 Claims, 7 Drawing Sheets

(56) References Cited

U.S. PATENT DOCUMENTS

| | | | | | |
|---|---|---|---|---|---|
| 3,983,523 | A * | 9/1976 | Ayers | H01F 27/362 | 336/84 R |
| 4,352,078 | A * | 9/1982 | Moore | H01F 27/18 | 336/197 |
| 5,990,775 | A * | 11/1999 | Inui | H01F 27/324 | 174/356 |
| 9,837,202 | B2 * | 12/2017 | Kainaga | H01F 27/362 | |

* cited by examiner

STATIONARY INDUCTION APPARATUS

TECHNICAL FIELD

The present invention relates to a stationary induction apparatus and particularly relates to a magnetic flux control structure for collecting leakage flux from a winding of a stationary induction apparatus and returning the leakage flux to an iron core.

BACKGROUND ART

In a case of using, in particular, a large iron core in a stationary induction apparatus configured with the iron core including an iron core leg part and an iron core yoke part, and a plurality of windings wound around the iron core leg part, then the iron core is clamped by upper and lower iron core clamps from both sides in a lamination thickness direction of the iron core, an iron core shape is firmly held, and the windings are held using the clamps.

Furthermore, it is known that the leakage flux generated from the windings in a case of driving the stationary induction apparatus may be a cause for a loss of an internal structure of the stationary induction apparatus or generation of electromagnetic-mechanical forces generated in the windings. Specifically, since much of the leakage flux from the windings diffuses into a space and enters the upper and lower iron core clamps before arrival at the iron core yoke part, eddy currents are generated in the clamps, resulting in the loss.

As one of methods of overcoming this problem, Japanese Patent Laid-Open No. 1990-148811 discloses a structure for installing a single magnetic material ring in each of upper and lower sides of a plurality of windings wound around an iron core leg part. There is shown that with using this configuration, magnetic flux leaking from end portions of the windings is absorbed by the magnetic material rings before diffusion into a space, and thereafter, the leakage flux flows within the magnetic material rings in an incident angle direction and arrives at an iron core yoke part before arrival at the clamps, so that effects of suppressing the generation of eddy currents in iron core clamps and reducing a loss are produced.

Meanwhile, in order for reducing generation of electromagnetic-mechanical forces generated in windings due to leakage flux, Japanese Patent Publication No. 1978-25092 proposes a structure that disc-shaped laminated magnetic materials having different radii are independently installed in respective end portions of a low-voltage winding and a high-voltage winding at one magnetic leg. With using this configuration, magnetic flux leaking from the end portions of the windings is absorbed by the magnetic material rings before diffusion into a space and arrives at an iron core yoke part; thus, magnetic flux distributions in the end portions of the winding change. Therefore, there is disclosed that the electromagnetic-mechanical forces are reduced, compared with a case in which the magnetic material rings are not Provided. There is also disclosed that preferred insulation properties can be obtained since the respective magnetic material rings are independently disposed in the end portions of the low-voltage winding and those of the high-voltage winding.

PRIOR ART DOCUMENT

Patent Document

[Patent Document 1]
Japanese Patent Laid-Open No. 1990-148811

[Patent Document 2]
Japanese Patent Publication No. 1978-25092

SUMMARY OF THE INVENTION

Problem to be Solved by the Invention

It is noted herein that the structure of Patent Document 1 can be expected to produce a certain effect of reducing the loss when the magnetic material rings that collect the leakage flux are disposed apart from the windings to such an extent that there occurs no problem in insulation. Nevertheless, it is not easy to obtain preferred magnetic flux density distributions in the end portions of the windings where it is necessary to reduce the electromagnetic-mechanical forces.

On the other hand, with the configuration disclosed in Patent Document 2, the magnetic material rings can be disposed near the windings and preferred magnetic fields in the winding parts for reducing the electromagnetic-mechanical forces can be obtained. However, Patent Document 2 does not disclose a fixing method and a cooling method for fixing and cooling magnetic flux control members including the magnetic material rings. In a winding clamp structure, not only an electromagnetic force in an axial direction (perpendicular direction) but also an electromagnetic force in a radial direction is generated. In this case, it is not easy to hold each magnetic flux control member including the magnetic material ring at a predetermined position against the electromagnetic forces only by a frictional force between the magnetic flux control member and an upper end surface of each winding. There is also possibility that the magnetic flux flows in the magnetic material ring within the magnetic flux control member and an iron loss is generated. Owing to this, it is required to maintain a temperature of each magnetic material ring and it is necessary to perform appropriate cooling.

An object of the present invention is, therefore, to provide a stationary induction electricity that includes an appropriately held and cooled magnetic material ring disposed in an end portion of each winding and that can reduce electromagnetic-mechanical forces and improve reliability.

Means for Solving the Problem

To attain the object, a stationary induction apparatus according to the present invention includes: an iron core; a winding wound outside of the iron core; a plurality of iron core clamps that sandwich the winding from a longitudinal direction of the iron core; a magnetic material ring configured with a silicon steel plate wound outside of the iron core; a laminated magnetic material composite ring that includes an insulator provided on an outer circumference of the magnetic material ring, that includes an electrical conductor provided on an outer circumference of the insulator, and that is disposed between the winding and each of the iron core clamps; and a holding-and-cooling structure disposed between the winding and the laminated magnetic material composite ring, in which a portion of the holding-and-cooling structure protruding from between the winding and the laminated magnetic material composite ring extends in the longitudinal direction, and the holding-and-cooling structure is a recess with respect to the winding and the laminated magnetic material composite ring.

Effect of the Invention

According to the present invention, it is possible to provide a stationary induction apparatus that includes an appropriately held and cooled magnetic material ring disposed in an end portion of each winding and that can reduce electromagnetic-mechanical forces and improve reliability.

MODES FOR CARRYING OUT THE INVENTION

Embodiments of the present invention will be described hereinafter with reference to the drawings. It is noted that the following contents just relate to the embodiments and it is not intended to limit modes of the present invention to the following specific contents.

First Embodiment

Figure 1:
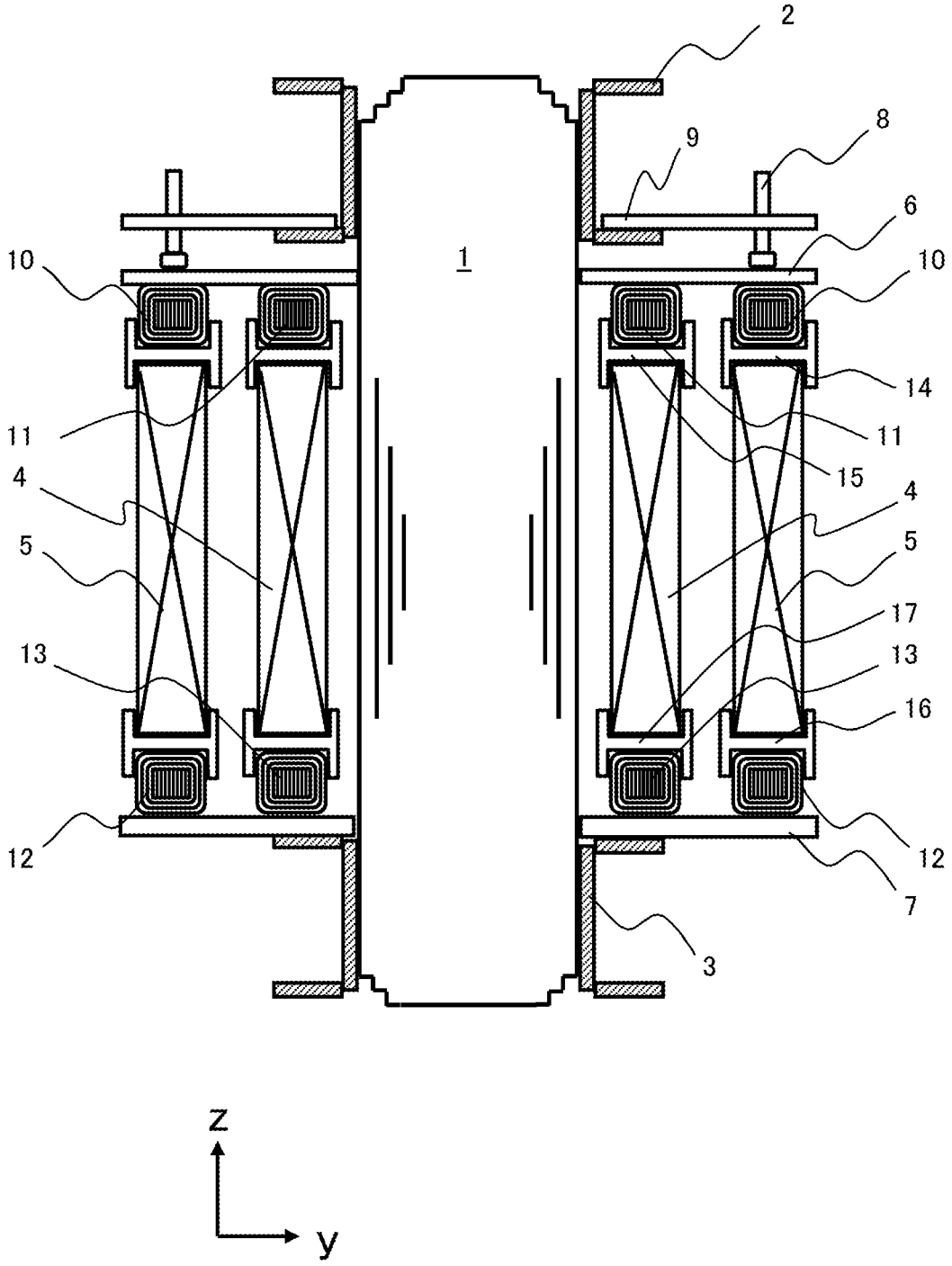
FIG. 1 is a longitudinal sectional view illustrating principal parts of a transformer according to a first embodiment.
Figure 2:
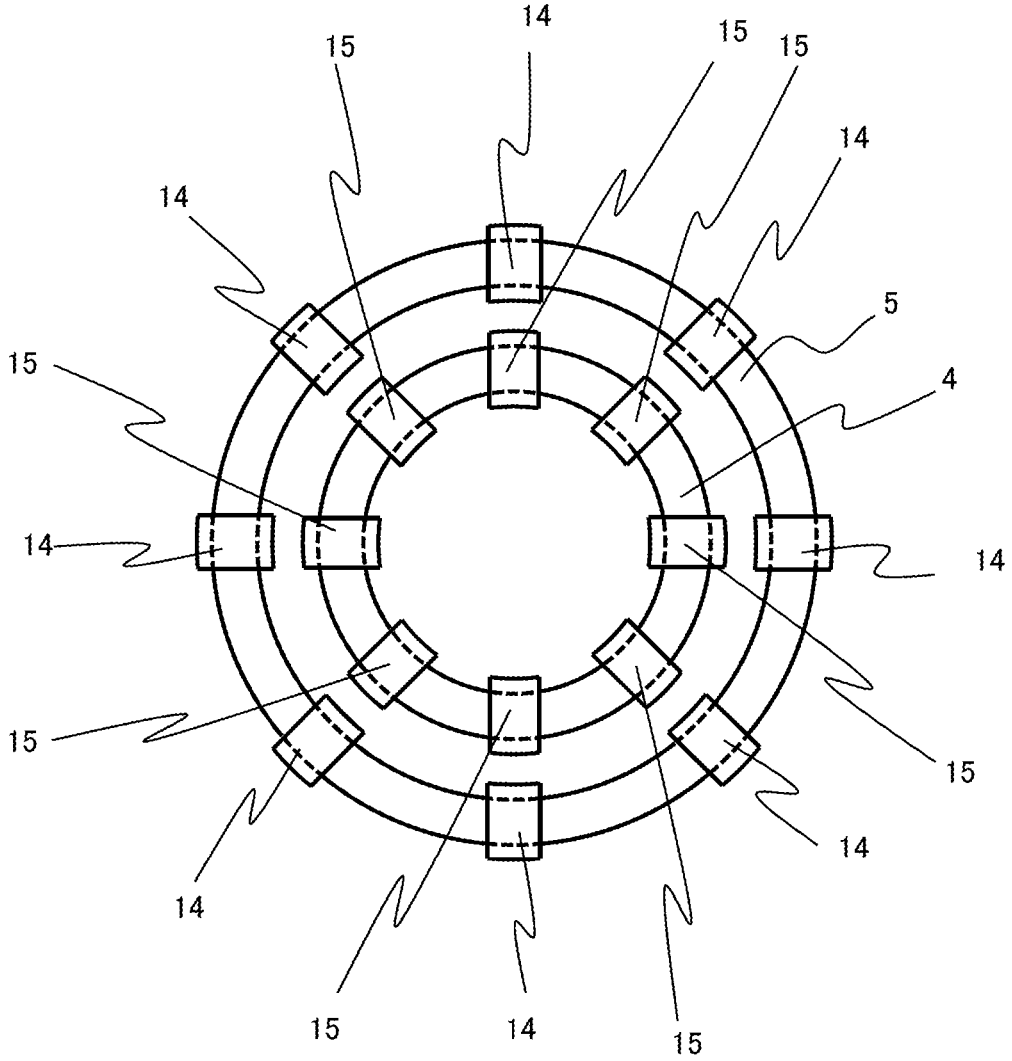
FIG. 2 is a bird's-eye view of windings and holding-and-cooling structural members of the transformer according to the first embodiment from axially above.
Figure 3:
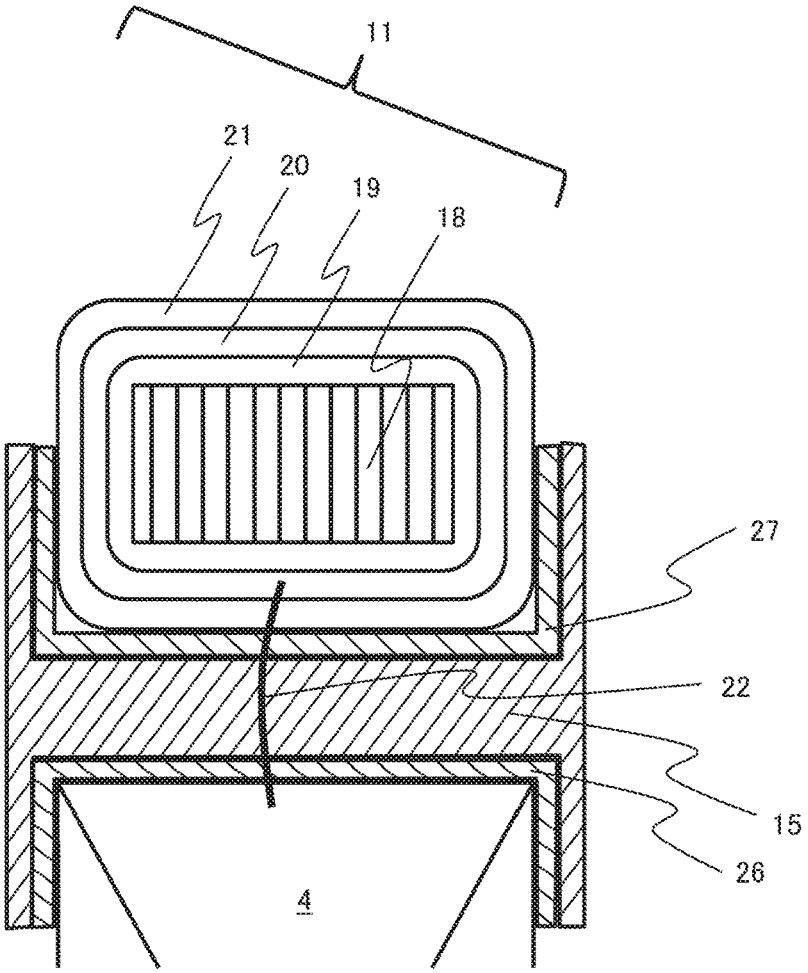
FIG. 3 illustrates an enlarged longitudinal sectional view illustrating the windings, the holding-and-cooling structural member, and a laminated magnetic material composite ring of the transformer according to the first embodiment.

A first embodiment will be described with reference to FIGS. 1 to 3. FIG. 1 is a longitudinal sectional view illustrating principal parts of a transformer according to the present embodiment. FIG. 2 is a bird's-eye view of windings 4 and 5 and upper holding-and-cooling structural members 14 and 15 of the transformer according to the first embodiment from axially above. FIG. 3 is an enlarged longitudinal sectional view illustrating the winding 4, the holding-and-cooling structural member 15, and a laminated magnetic material composite ring 11, which are included in the embodiment illustrated in FIG. 1.

As illustrated in FIG. 1, the principal parts of the transformer include an iron core 1 having an iron core leg part and an iron core yoke part formed by laminating a plurality of silicon steel plates, a low-voltage-side winding 4 wound around the iron core leg part, and a high-voltage-side winding 5 wound outside of the low-voltage-side winding 4. The iron core 1 is fixed by an upper iron core clamp 2 disposed above the windings and a lower iron core clamp 3 disposed below the windings.

The upper iron core clamp 2 is provided with an overhanging structure 9. A winding pressing member 8 is attached to a lower surface of the overhanging structure 9. The winding pressing member 8 fixes members around the windings. Specifically, the winding pressing member 8 has a structure of axially clamping and positioning entirety of an upper insulating rigid member 6, upper laminated magnetic material composite rings 10 and 11, upper holding-and-cooling structural members 14 and 15, the low-voltage-side winding 4, the high-voltage-side winding 5, lower holding-and-cooling structural members 16 and 17, and lower laminated magnetic material composite rings 12 and 13 by pressing the entirety against a lower insulating rigid member 7 from above.

As illustrated in FIG. 1, the upper holding-and-cooling structural members 14 and 15 disposed above and below the windings are shaped in such a manner that the upper holding-and-cooling structural members 14 and 15 are disposed to be sandwiched between the windings 4 and 5 and the upper laminated magnetic material composite rings 10 and 11, and that inside diameter sides and outside diameter sides of the upper holding-and-cooling structural members 14 and 15 protrude from the windings 4 and 5 and the upper laminated magnetic material composite rings 10 and 11 in an inside diameter direction and an outside diameter direction. A protruding portion extends in a vertical direction and each of the upper holding-and-cooling structural members is H-shaped when being viewed from a longitudinal sectional direction of FIG. 1. Furthermore, an axial length of the protruding portion is larger than a distance between the winding and the laminated magnetic material composite ring. Similarly to the upper holding-and-cooling structural members 14 and 15, the lower holding-and-cooling structural members 16 and 17 disposed below the windings are shaped in such a manner that the lower holding-and-cooling structural members 16 and 17 are disposed to be sandwiched between the windings 4 and 5 and the lower laminated magnetic material composite rings 12 and 13, and that inside diameter sides and outside diameter sides of the lower holding-and-cooling structural members 16 and 17 protrude from the windings 4 and 5 and the lower laminated magnetic material composite rings 12 and 13 in the inside diameter direction and the outside diameter direction. By configuring each of the holding-and-cooling structural members to have such a structure, the protruding portion of the holding-and-cooling structural member takes the form of a recess with respect to objects present above or below the protruding portion and can support the objects by being inserted into the objects. It is, therefore, possible to firmly fix the upper laminated magnetic material composite rings 10 and 11, the upper holding-and-cooling structural members 14 and 15, the low-voltage-side winding 4, the high-voltage winding 5, the lower holding-and-cooling structural members 16 and 17, and the lower laminated magnetic material composite rings 12 and 13 not only in an axial direction but also in the radial direction.

The holding-and-cooling structural member 15 will be further described. The upper holding-and-cooling structural member 15 is disposed between the upper laminated magnetic material composite ring 11 and the low-voltage-side winding 4 in the axial direction. The upper holding-and-cooling structural member 15 is configured with a horizontal member and perpendicular members provided on both ends perpendicularly, and is H-shaped in the enlarged longitudinal sectional view of FIG. 3. A dimension of the upper holding-and-cooling structural member 15 in a direction perpendicular to a sheet of FIG. 3 is set to a predetermined length in the light of electromagnetic-mechanical forces and cooling. The upper holding-and-cooling structural member 15 is disposed to be fitted into an upper portion of the low-voltage-side winding 4, and the laminated magnetic material composite ring 11 is disposed thereon. The upper holding-and-cooling structural member 15 is made of metal and is provided with protection members 26 and 27 for protecting adjacent insulators. Although not illustrated, the upper holding-and-cooling structural member 15 and the upper laminated magnetic material composite ring 11 are electrically connected and equipotential to each other. It is thereby possible to implement the laminated magnetic material composite ring 11 in a state of a small potential difference between the low-voltage winding 4 and the laminated magnetic material composite ring 11. It is noted that not the metal but an insulator (fiber reinforced plastic or the like) may be used for the holding-and-cooling structural member, depending on a magnitude of the electro-mechanical forces. The structure of the holding-and-cooling structural member described above also applies to the upper holding-and-cooling structural member (high-voltage winding side) 14 and the lower holding-and-cooling structural members 16 and 17.

Functions of the parts particularly related to electromagnetic characteristics in the longitudinal sectional view of the transformer according to the present embodiment illustrated in FIG. 1 will next be described. The members related to the electromagnetic characteristics include the iron core 1, the upper clamp 2, the lower clamp 3, the low-voltage-side winding 4, the high-voltage-side winding 5, the upper high-voltage-side laminated magnetic material composite ring 10, the upper low-voltage-side laminated magnetic material composite ring 11, the lower high-voltage-side laminated magnetic material composite ring 12, and the lower low-voltage-side laminated magnetic material composite ring 13. A magnetic action of the laminated magnetic material composite rings will now be described. For example, magnetic flux leaking upward from the winding 4 enters the laminated magnetic material composite ring 11, flows within the laminated magnetic material composite ring 11 in an incident angle direction, and then enters the iron core 1. In other words, the laminated magnetic material composite ring 11 acts to produce a magnetic short-circuit between an end portion of the winding 4 and the iron core 1.

FIG. 2 illustrates the transformer in the embodiment illustrated in FIG. 1 viewed from above (it is noted, however, that FIG. 2 only depicts the holding-and-cooling structural members and the windings). The holding-and-cooling structural members 14 and 15 are disposed to radially spread about a center of the transformer in FIG. 2. Adopting such disposition makes it possible to hold characteristics for cooling the transformer without disturbing a flow of a fluid such as oil filled around the transformer and cooling the transformer, and, at the same time, to fix the windings 4 and 5 in the radial direction. Further, it is possible to cool the holding-and-cooling structural members 14 and 15 themselves by the fluid such as the oil cooling the transformer.

The laminated magnetic material composite rings and the holding-and-cooling structural members according to the present embodiment of the present invention will be described in detail with reference to FIG. 3. The upper laminated magnetic material composite ring 11 is disposed above the low-voltage-side winding 4. Normally, the upper laminated magnetic material composite ring 11 is formed by winding silicon steel plates or the like concentrically with respect to the iron core 1. An innermost side of the upper laminated magnetic material composite ring 11 configures a magnetic material ring 18 and around the magnetic material ring 18 is covered with an insulator 19. An outer side of the insulator 19 is then covered with an electrical conductor 20, and the electrical conductor 20 is covered with insulating paper 21 normally by winding the insulating paper 21 around outside of the electrical conductor 20 for insulation. Furthermore, an electrical lead wire 22 is provided in the electrical conductor 20 and electrically connected to the low-voltage-side winding 4, thus making the low-voltage-side winding 4 and the laminated magnetic material composite ring 11 equipotential. It is thereby possible to implement the laminated magnetic material composite ring 11 in a state of the small potential difference between the low-voltage winding 4 and the laminated magnetic material composite ring 11.

Figure 4:
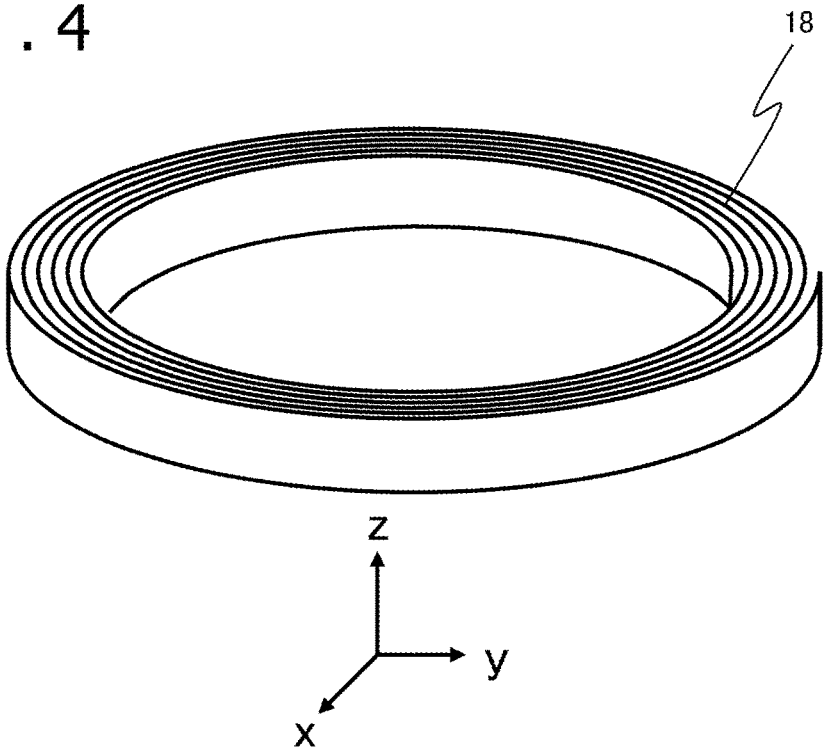
FIG. 4 is a bird's-eye view of a silicon steel plate ring 18 that configures the laminated magnetic material composite ring of the transformer according to the first embodiment.
Figure 5:
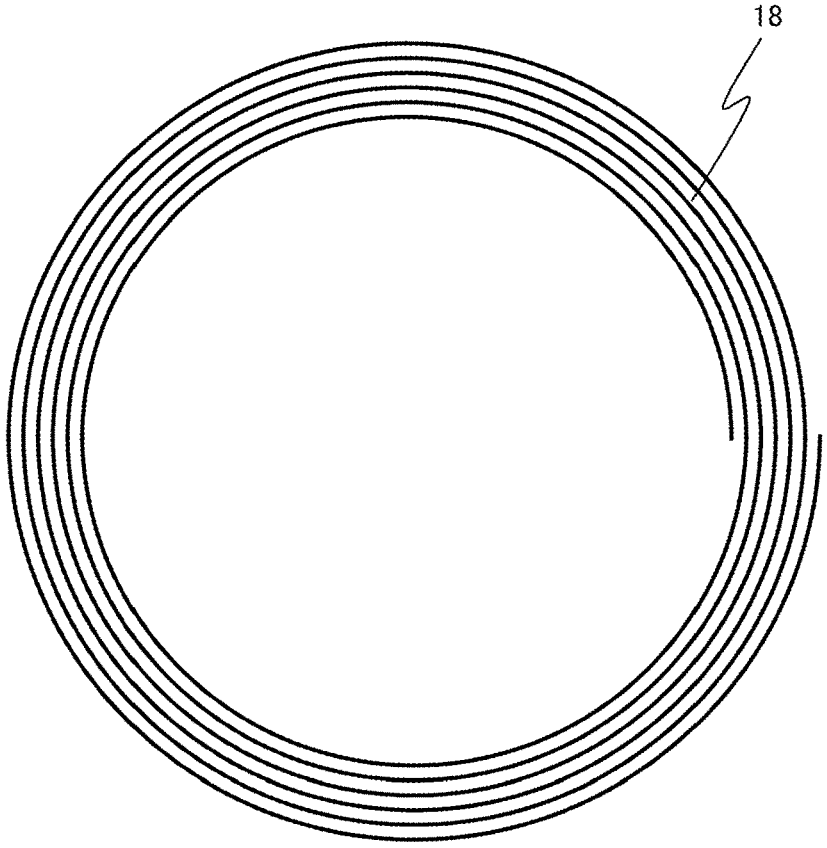
FIG. 5 illustrates the silicon steel plate ring 18 that configures the laminated magnetic material composite ring of the transformer according to the first embodiment.

A structure of the magnetic material ring that configures each laminated magnetic material composite ring will be described with reference to FIGS. 4 and 5. FIG. 4 illustrates the magnetic material ring 18 viewed from an oblique direction, while FIG. 5 illustrates the magnetic material ring 18 viewed from above. In the present embodiment, the magnetic material ring 18 is formed by concentrically laminating band-like silicon steel plates and bonding the silicon steel plates by a resin. It is noted that silicon steel plates having a length direction that is a direction of magnetization easy axis are used as the band-like silicon steel plates, and that the band-like silicon steel plates enable the magnetic flux leaking from the end portion of the winding 4 and entering the magnetic material ring 18 to efficiently flow in the incident angle direction.

Figure 6:
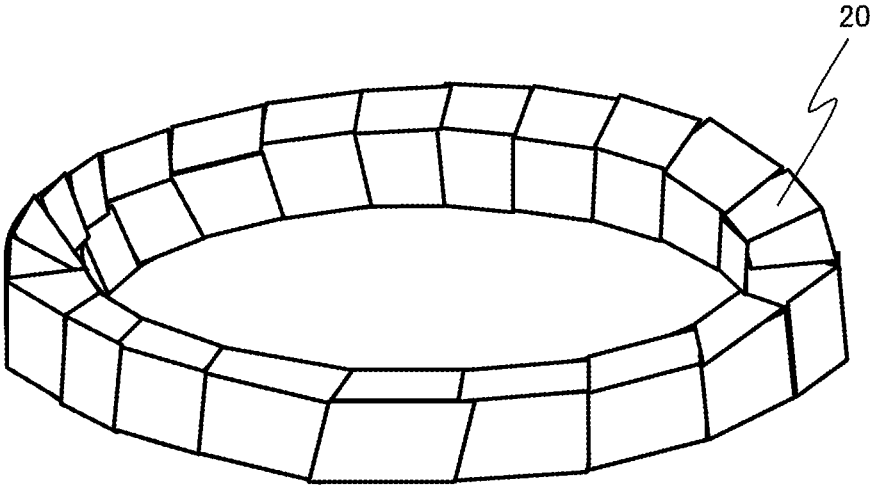
FIG. 6 illustrates a wound aluminum tape wound around the silicon steel plate ring that configures the laminated magnetic material composite ring of the transformer according to the first embodiment.

Details of the electrical conductor that configures each laminated magnetic material composite ring will next be described. FIG. 6 illustrates a member viewed obliquely after the electrical conductor is provided. The laminated magnetic material composite ring is produced by covering the silicon steel plate ring 18 depicted in FIG. 4 with the insulator 19 and further with the electrical conductor 20. Specifically, the electrical conductor 20 is configured by winding a high-conducting tape such as an aluminum tape around the silicon steel plate ring 18 covered with the insulator. Moreover, the insulating layer 21 is configured by winding an insulating paper tape in a similar fashion. Furthermore, although not illustrated, it is possible to electrically connect the electrical conductor 20 to the winding 4 to make the electrical conductor 20 and the winding 4 equipotential, and implement the laminated magnetic material composite ring 11 while making small a potential difference between the electrical conductor 20 and the winding 4.

In the present invention, a plurality of holding-and-cooling structural members that prevent radial misalignment of each of the laminated magnetic material composite rings provided with the electrically conductive member and the corresponding winding and that enable heat dissipation from the laminated magnetic material composite ring are disposed between the laminated magnetic material composite ring and the end portion of the winding. This produces effects that the electromagnetic-mechanical forces can be reduced, and that even if the electromagnetic-mechanical forces work, it is possible to hold down a temperature increase of the laminated magnetic material composite ring by sufficiently cooling the laminated magnetic material composite ring without causing the radial misalignment of the laminated magnetic material composite ring and the winding.

Furthermore, according to the present embodiment, even if the electromagnetic-mechanical forces different in direction and magnitude work on each of the windings and the laminated magnetic material composite rings, it is possible to prevent a mechanical failure of the winding by restricting relative displacements by the holding-and-cooling structural member. Moreover, the present embodiment produces effects that a cooling area of each upper laminated magnetic material composite ring can be increased by insertion of the holding-and-cooling structural member, and that the temperature increase of the magnetic material ring can be reduced to approximately 30% of that of a case in which the holding-and-cooling structural member is not used.

Second Embodiment

Figure 7:
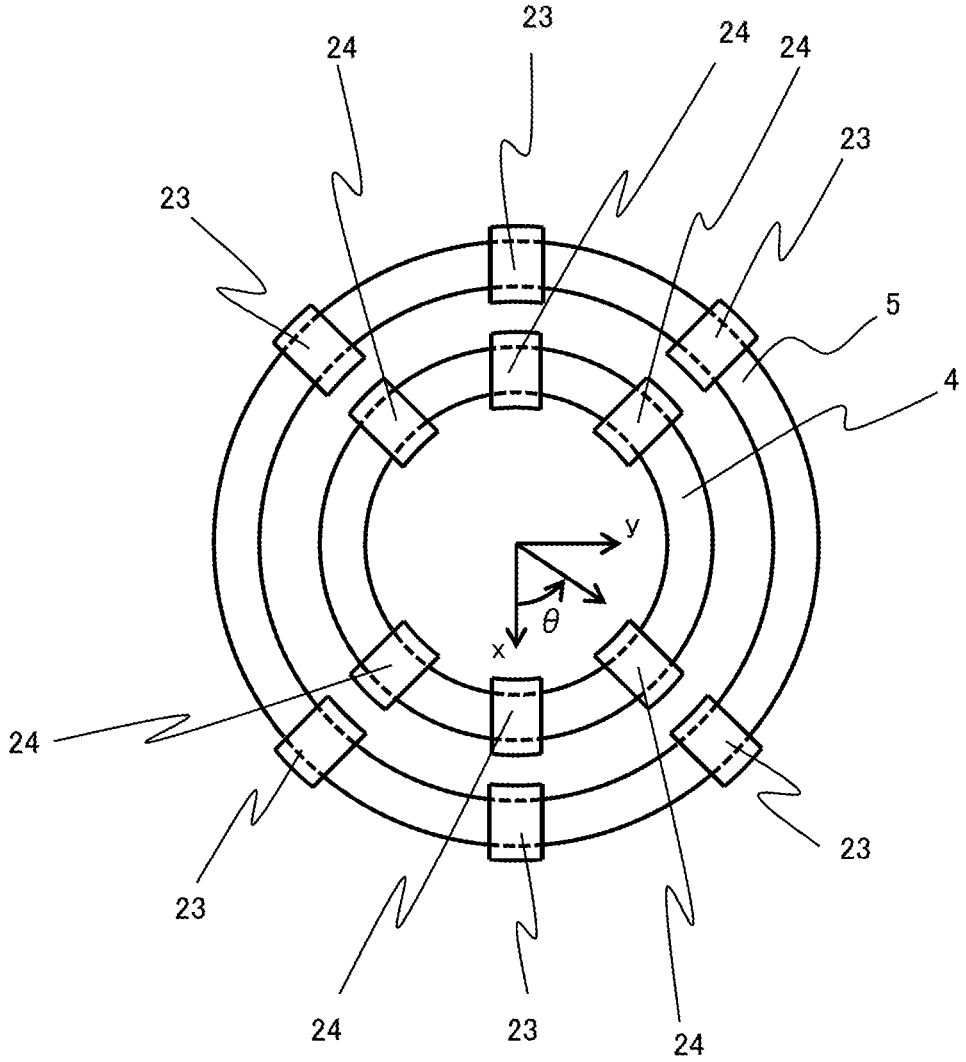
FIG. 7 is a bird's-eye view of windings and holding-and-cooling structural members of a transformer according to a second embodiment from axially above.

A second embodiment of the present invention will next be described with reference to FIGS. 7 and 8. FIG. 7 illustrates the low-voltage-side winding 4, the high-voltage-side winding 5, and upper holding-and-cooling structural members 23 and 24, which are parts of the transformer. A configuration of the present embodiment is similar to that of the first embodiment except for a difference in the numbers of the upper holding-and-cooling structural members 23 and 24 and a way in which the upper holding-and-cooling structural members 23 and 24 are disposed either densely or coarsely.

Although not illustrated, the transformer according to the present embodiment is a three-phase transformer, an origin of coordinates in FIG. 7 is a center of a V phase, and legs of U, V, and W phases are arranged in an x-axis direction. FIG. 8 illustrates an electromagnetic-mechanical force 25 that is generated in the upper laminated magnetic material composite ring 11 when the transformer is excited and a current of the V phase is a maximum current. A horizontal axis in FIG. 8 represents an angle illustrated in FIG. 7.

Figure 8:
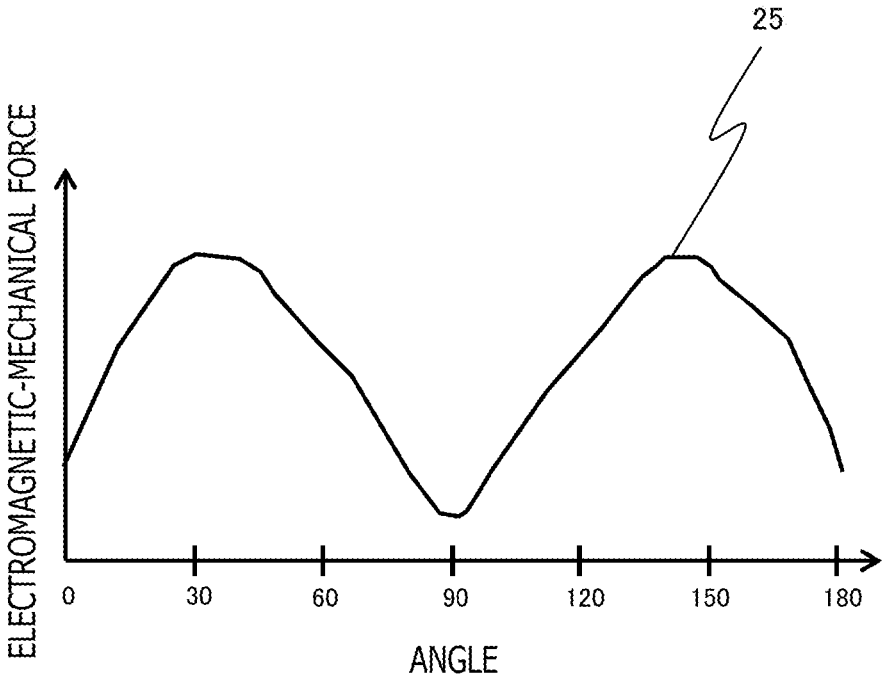
FIG. 8 is a graph that depicts an electromagnetic-mechanical force generated in a laminated magnetic material composite ring of the transformer according to the second embodiment.

As illustrated in FIG. 8, the electromagnetic-mechanical force is the lowest in a case of an angle θ of 90 degrees, and is the highest in a case of the angle θ of approximately 30 degrees. In the light of the above, more holding-and-cooling structural members are disposed in sites where the electromagnetic-mechanical force is relatively high, as illustrated in FIG. 7 of the present embodiment. The site where the electromagnetic-mechanical force is relatively high means a site that is not a site where the electromagnetic-mechanical force indicates a minimum value. In other words, the holding-and-cooling structural members are disposed to spread on radial lines from the origin either densely or coarsely, depending on a magnitude distribution of the electromagnetic-mechanical force.

According to the present embodiment, restricting the relative displacements of each winding and the corresponding laminated magnetic material composite ring by the holding-and-cooling structural member makes it possible to not only prevent the mechanical failure of the winding but also reduce the temperature increase of the magnetic material ring to approximately 25% of that in a case in which the holding-and-cooling structural member is not used.

DESCRIPTION OF REFERENCE CHARACTERS

1: Iron core
2: Upper iron core clamp
3: Lower iron core clamp
4: Low-voltage-side winding
5: High-voltage-side winding
6, 7: Insulating rigid members
8: Winding pressing member
9: Overhanging structure
10, 11: Upper laminated magnetic material composite rings
12, 13: Lower laminated magnetic material composite rings
14, 15: Upper holding-and-cooling structural members
16, 17: Lower holding-and-cooling structural members
18: Silicon steel plate ring
19: Insulating member
20: Electrical conductor
21: Insulator by insulating paper tape
22: Conductive wire
23, 24: Upper holding-and-cooling structural members
25: Electromagnetic-mechanical force generated in silicon steel plate ring in upper laminated magnetic material composite ring
26, 27: Protection members

The invention claimed is:

1. A stationary induction apparatus comprising:
an iron core;
a winding wound outside of the iron core;
a plurality of iron core clamps that sandwich the winding from a longitudinal direction of the iron core;
a magnetic material ring configured with a silicon steel plate wound outside of the iron core;
a laminated magnetic material composite ring that includes an insulator provided on an outer circumference of the magnetic material ring, that includes an electrical conductor provided on an outer circumference of the insulator, and that is disposed between the winding and each of the iron core clamps; and
a holding-and-cooling structure disposed between the winding and the laminated magnetic material composite ring, wherein
a portion of the holding-and-cooling structure, protruding from between the winding and the laminated magnetic material composite ring, extends in the longitudinal direction, and the holding-and-cooling structure is a recess with respect to the winding and the laminated magnetic material composite ring.

2. The stationary induction apparatus according to claim 1, wherein
the laminated magnetic material composite ring is disposed on a radial line with the iron core as a center.

3. The stationary induction apparatus according to claim 1, comprising
a lead wire that electrically connects the electrical conductor to the winding.

4. The stationary induction apparatus according to claim 1, wherein
the electrical conductor is aluminum.

5. The stationary induction apparatus according to claim 1, wherein
the holding-and-cooling device is disposed in a portion of the stationary induction apparatus at which portion an electromagnetic-mechanical force is relatively high.

* * * * *